US008425627B2

(12) United States Patent
Dietz et al.

(10) Patent No.: US 8,425,627 B2
(45) Date of Patent: Apr. 23, 2013

(54) FUEL ADDITIVE CONCENTRATE COMPOSITION AND FUEL COMPOSITION AND METHOD THEREOF

(75) Inventors: Jeffry G. Dietz, Shaker Hts., OH (US); Jonathan S. Vilardo, Chardon, OH (US); Keith Corkwell, Newbury, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 613 days.

(21) Appl. No.: 12/091,988

(22) PCT Filed: Nov. 3, 2006

(86) PCT No.: PCT/US2006/043267

§ 371 (c)(1),
(2), (4) Date: Apr. 29, 2008

(87) PCT Pub. No.: WO2007/053787

PCT Pub. Date: May 10, 2007

(65) Prior Publication Data

US 2008/0282607 A1 Nov. 20, 2008

Related U.S. Application Data

(60) Provisional application No. 60/734,004, filed on Nov. 4, 2005.

(51) Int. Cl.
*C10L 1/18* (2006.01)

(52) U.S. Cl.
USPC ..... 44/385; 44/403; 44/434; 44/437; 44/450; 44/451

(58) Field of Classification Search ..... 44/385, 44/403, 434, 437, 450, 451
See application file for complete search history.

(56) References Cited

U.S. PATENT DOCUMENTS

| | | | | |
|---|---|---|---|---|
| 4,128,403 | A * | 12/1978 | Honnen | 44/374 |
| 4,440,545 | A * | 4/1984 | Weidig | 44/351 |
| 4,549,882 | A | 10/1985 | Knapp | |
| 5,968,211 | A | 10/1999 | Schilowitz | |
| 6,224,642 | B1 | 5/2001 | Daly et al. | |
| 7,195,654 | B2 * | 3/2007 | Jackson et al. | 44/388 |

FOREIGN PATENT DOCUMENTS

WO 2005/019394 A1 3/2005

OTHER PUBLICATIONS

Corresponding PCT Publication WO 2007/053787 A1 and Search Report; published May 10, 2007.
Written Opinion of corresponding PCT Publication WO 2007/053787; completed Feb. 19, 2007.

* cited by examiner

*Primary Examiner* — Cephia D Toomer
(74) *Attorney, Agent, or Firm* — Christopher D. Hilker

(57) ABSTRACT

A fuel additive concentrate comprises a friction modifier selected from the group consisting of an alkoxylated fatty amine, a fatty acid or derivative thereof, and mixture thereof; an alcohol; and a compatibilizer selected from the group consisting of a low molecular weight carboxylic acid or anhydride or derivative there of, glycol ether, alkylated phenol, and a mixtures thereof wherein the fuel additive concentrate remains fluid at −80 C or lower wherein the solvent has enough aromatic content to permit the fuel additive concentrate to be a fluid at minus 80 C. A fuel composition comprises fuel and the fuel additive concentrate. A method of operating a gasoline internal combustion engine comprises fueling the engine with the fuel composition and is effective in reducing fuel consumption.

14 Claims, No Drawings

FUEL ADDITIVE CONCENTRATE COMPOSITION AND FUEL COMPOSITION AND METHOD THEREOF

BACKGROUND OF THE INVENTION

Description of the Related Art

The reduction of engine wear and friction in internal combustion engines continues to be of importance especially with increased fuel costs and the limited future supplies of hydrocarbon reserves. Reduction of engine wear and friction is addressed through the use of appropriate lubricating oil applications. However, engine wear reduction and friction control also often necessitates the formulation of fuels such as diesel fuel and gasoline with enhanced lubricity characteristics. One class of compounds capable of improving fuel economy is the substituted hydrocarbons having 12 to 36 carbon atoms. These hydrocarbons are typically substituted with surface active functional groups including carboxylic acids, alcohols, and amines.

U.S. Pat. No. 6,224,642 disclose compositions that include a polyetheramine and substituted hydrocarbons selected from the group that includes fatty acids, fatty acid amides, fatty acid esters, hydrocarbyl substituted succinic acids, hydrocarbyl substituted succinic anhydrides, amide, imide or ester derivatives of, hydrocarbyl substituted succinic anhydrides, and alkoxylated amines. The enhanced lubricity characteristics of fuel compositions containing these additives were demonstrated by the reduction of the wear scar of the fuel in the high frequency reciprocation rig using test method ASTM D6079-97.

U.S. Pat. No. 4,617,026 disclose a method to reduce fuel consumption in a gasoline engine by including a fuel additive that is an ester having at least one free hydroxyl group and formed from a monocarboxylic acid and a glycol or trihydric alcohol. The monocarboxylic acid has about 12 to 30 carbon atoms. The example cited was glycerol mono-oleate which derived for the fatty acid oleic acid.

U.S. Pat. No. 4,236,898 discloses fuel compositions which reduce friction between sliding metal surfaces in internal combustion engines from the addition to the hydrocarbon fuel a sulfurized fatty acid amide, ester, or ester-amides. Exemplary examples of fatty acids include oleic, linoleic, elaidic, erucic and tall oil fatty acids.

U.S. Pat. Nos. 6,835,217 and 6,743,266 disclose a fuel composition comprising the reaction product of a natural or synthetic oil and at least one alkanolamine and at least one fuel detergent. Exemplary examples of natural oils are the naturally occurring oils that are derived from animal or plant sources. Such oils are mixed C6-C22 fatty acid esters.

U.S. Pat. No. 6,203,584 disclose fuel compositions that include aliphatic hydrocarbyl substituted amines and/or polyetheramines and esters of carboxylic acids and polyhydric alcohols to improve fuel economy. Wherein, the carboxylic acid has from one to about 50 carbon, atoms and the polyhydric alcohol has from about 2 to about 50 carbon atoms and from about 2 to about 6 hydroxy groups. Suitable carboxylic acids include saturated and unsaturated fatty acids such as capric, lauric, palmitic, stearic, linoleic, and linolenic acids.

U.S. Pat. No. 4,729,769 discloses a motor fuel composition containing a minor amount of a detergent additive being the reaction product of a C6-C20 fatty acid ester and a mono- or di-(hydroxy hydrocarbonyl) amine. Typical fatty acid esters used include the esters of lauric, palmitic, stearic, oleic, and linoleic acids.

U.S. Pat. Nos. 5,958,089; 6,280,488; 5,858,028; 5,833,722; 5,882,364; and 5,833,722 disclose fuel compositions that include a fuel oil having a low sulfur content and an mono- and poly-carboxylic acid or the ester of a polyhydric alcohol and a mono- or poly-carboxylic acid to enhance lubricity of the fuel. Exemplary mono- and poly-carboxylic acids include the fatty acids oleic and linoleic acids as well as the oligomers of polyunsaturated fatty acids such as dilinoleic acid.

Solving the Low Temperature

U.S. Pat. No. 6,866,690 describes a friction modifier for use in fuels that is n-butyl amine isostearate. The use of this friction modifier in combination with a detergent package permits increased fuel efficiency without increasing the incidence of IVD deposits.

Unfortunately, the hydrocarbons of these friction modifiers typically are low molecular weight unsaturated or mono-unsaturated hydrocarbons in order to provide the frictional characteristics necessary to make them friction modifiers. Unsaturated low molecular weight saturated or mono-unsaturated hydrocarbons have waxy characteristics and encounter poor solubility at low temperatures. Stable fuel additive concentrates are required to facilitate injection of the concentrate into fuel. This requires the concentrate to be in the form of a low viscosity, homogeneous liquid.

U.S. Pat. No. 5,968,211 filed May 26, 1998 (Schilowitz) discloses gasoline lubricity additive selected from the group consisting of saturated and unsaturated fatty acids, oligomerized saturated and unsaturated fatty acids, esters of such fatty acids and of oligomerized fatty acids and mixtures thereof. In order to improve the low temperature properties of a concentrate containing the lubricity additive in relatively high concentration, a compatibilizer, which remains liquid to a temperature of at least 0° C., and selected from the group consisting of an alcohol, an amine or mixtures of alcohols and amines was used. All working examples in this patent use a commercial, sample of a mixture of tall oil fatty acids available from Petrolite Ltd. known as Tolad 9103. Tolad 9103 is defined in the patent to comprise a mixture of polymerized fatty acids, non-polymerized fatty acids and heavy aromatic naphtha and requires a compatibilizer that is liquid at 0° C.

U.S. Pat. No. 6,524,353 discloses a fuel additive composition composed of the reaction product of a mixture of fatty acid esters having 6 to 20 carbon atoms and a low molecular weight ester having 3 to 10 carbon atoms with mono- or di-hydroxy alkyl amines. The inclusion of the low molecular weight ester reactant is to improve the low temperature properties of the friction modifiers.

U.S. Pat. No. 6,277,158 discloses an additive concentrate for use in fuels comprising an ashless friction modifier selected from n-butylamine oleate, tall oil fatty acid, and mixtures thereof along with a deposit inhibitor and a fluidizer. This patent discloses good low temperature stability when using a commercial sample of a mixture of tall oil fatty acids available from Petrolite Ltd. as Tolad 9103. Tolad, 9103 comprises a mixture of polymerized fatty acids, non-polymerized fatty acids and heavy aromatic naphtha. Unfortunately, examples in the patent indicate that similar low temperature enhancement is not obtained with friction modifiers such as glycerol mono oleate, polyol ester of oleic acid, a fatty amide, and a sorbitan mono oleate.

U.S. Patent Application 2002/0174597 discloses a gasoline additive concentrate comprising a solvent, an alkoxylated fatty amine, and a partial ester having at least one free hydroxyl group. The solvent providing an additive concentrate that is homogenous for facile transferring and handling of the concentrate composition. The solvent is selected from the group consisting of aliphatic hydrocarbons, aromatic hydrocarbons, $C_2$-$C_{10}$ alcohols, and mixtures of two or more thereof. The preferred choice of solvent is that's allowing the concentrate composition to be liquid at a temperature from about 0° C. to minus 18° C. For some terminal application, additive concentrates must be fluid at temperatures below minus 18° C.

It has now been found that the fuel additive concentrate composition that remains fluid at below ambient temperatures, such as 0° C. to −18° C., of the present invention when used in a fuel composition provides a way to reduce fuel consumption in gasoline internal combustion engines. The benefits of this invention are both economic and environmental and include reduced fuel costs, fuel conservation, and reduced emission of greenhouse gases.

SUMMARY OF THE INVENTION

The present invention provides a fuel additive concentrate comprising, a) a solvent other than component (c);

b) a friction modifier selected from the group consisting of an alkoxylated fatty amine, a fatty acid or derivative thereof, and mixture thereof;

c) an alcohol; and d) a compatibilizer selected from the group consisting of a low molecular weight carboxylic acid or anhydride or derivative there of, glycol ether, alkylated phenol, and a mixtures thereof.

wherein the fuel additive concentrate remains fluid at −8° C. or lower wherein the solvent of component (a) has enough aromatic content to permit the fuel additive concentrate to be a fluid at −8° C.

The present invention further provides a method for fueling an internal combustion engine, comprising supplying to the engine the fuel additive concentrate and a fuel.

The present invention further provide for a fuel composition comprising the fuel additive concentrate and a fuel.

DETAILED DESCRIPTION OF THE INVENTION

Various preferred features and, embodiments will be described below by way of non-limiting illustration.

Field of the Invention

This invention involves a fuel additive concentrate, a fuel composition that includes the fuel additive concentrate and fuel, and a method of operating a gasoline internal combustion engine with the fuel composition. The compositions and methods of the present invention reduce fuel consumption in an internal combustion engine.

Solvent

The fuel additive concentrate of the present invention can comprise a solvent. The solvent in the present invention provides for a homogeneous and liquid fuel additive concentrate and for facile transferring and handling of the fuel additive concentrate composition. The solvent also provides for a homogeneous fuel composition comprising gasoline and the concentrate composition. The solvent is selected from the group consisting of aliphatic hydrocarbons and aromatic hydrocarbons. The solvent generally boils in the range of about 65° C. to 235° C. Aliphatic hydrocarbons include various naphtha and kerosene boiling point fractions that have a majority of aliphatic components. Aromatic hydrocarbons include benzene, toluene, xylenes and various naphtha and kerosene boiling point fractions that have a majority of aromatic components. In one embodiment, the solvent can be present in the fuel additive concentrate at about 1.0 to 90% by weight, in another embodiment at about 25 to 85% by weight, and yet in another embodiment, at about 40 to 80% by weight. Typical solvents include aromatic hydrocarbons and mixtures of alcohols with aromatic hydrocarbons or kerosene having enough aromatic content that allows the fuel additive concentrate to be a fluid at a temperature from about 0° C. to minus 18° C.

Alcohols

The fuel additive concentrate of the present invention can comprise an alcohol. Alcohols can be aliphatic alcohols having about 2 to 16 or 2 to 10 carbon atoms. In one embodiment, the alcohol an be ethanol, 1-propanol, isopropyl alcohol, 1-butanol, isobutyl alcohol, amyl alcohol, isoamyl alcohol, and 2-methyl-1-butanol.

In one embodiment, the alcohol can be present in the fuel additive concentrate to about 5 to 35% by weight, in another embodiment about 8 to about 25% by weight, and in another embodiment from 10 to 25% by weight when the fuel additive concentrate does not contain the ashless detergent.

In one embodiment, the alcohol can be present in the fuel additive concentrate composition to about 5 to about 20% by weight, in another embodiment from 8 to about 15% by weight, and yet another embodiment from about 9 to about 12% by weight when the fuel additive concentrate contains the ashless detergent.

Friction Modifier

The fuel additive concentrate of the present invention can comprise a friction modifier. The friction modifier can be selected from the group consisting of an alkoxylated fatty anine, fatty acid or derivative thereof, and mixtures thereof.

Alkoxylated Fatty Amine

The alkoxylated fatty amine of the present invention can include amines represented by the formula:

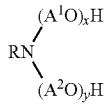

where R is a hydrocarbyl group having about 4 to 30 carbon atoms, $A^1$ and $A^2$ are vicinal alkylene groups, and the sum of x and y is an integer and is at least 1. The hydrocarbyl group is a univalent radical of carbon atoms that is predominantly hydrocarbon in nature, but can have nonhydrocarbon substituent groups and can have heteroatoms. The hydrocarbyl group R can be an alkyl or alkylene group of about 4 to 30 carbon atoms, preferably about 10 to 22 carbon atoms. The vicinal alkylene groups $A^1$ and $A^2$ can be the same or different and include ethylene (—$CH_2$—), propylene (—$CH_2CH_2CH_2$—) and butylene (—$CH_2CH_2CH_2CH_2$—) having the carbon to nitrogen and carbon to oxygen bonds on adjacent or neighboring carbon atoms. Examples of alkoxylated fatty amines include: diethoxylated stearylamine, diethoxylated oleylamine, diethoxylated stearylamine, and the diethoxylated amine from soybean oil fatty acids. Alkoxylated fatty amines are commercially available from Akzo under the Ethomeen® series.

Fatty Acid or Derivative Thereof

The fatty acid or derivative thereof can have about 4 to 30 carbon atoms, 8 to 26 carbon atoms in another instance, and 12 to 22 carbon atoms in yet another instance. Saturated and unsaturated monocarboxylic acids are useful and include capric, lauric, myristic, palmitic, stearic, behenic, oleic, petroselinic, elaidic, palmitoleic, linoleic, linolenic and erucic acid. Typical fatty acids are those derived from natural oil typically containing C6 or C22 fatty acid esters, i.e., glycerol fatty acid esters or triglycerides derived from natural sources, for use herein include, but are not limited to beef tallow oil, lard oil, palm oil, castor oil, cottonseed oil, corn oil, peanut oil, soybean oil, sunflower oil, olive oil, whale oil, coconut oil, palm oil, rape oil, and soya oil.

In another embodiment of this invention, the fatty acid can be the partial ester of a fatty carboxylic acid. The partial ester of the present invention has at least one free hydroxyl group and is formed by reacting at least one fatty carboxylic acid and at least one polyhydric alcohol.

The fatty carboxylic acid used to form the partial ester can be saturated or unsaturated aliphatic, can be branched or straight chain, can be a monocarboxylic or polycarboxylic acid, and can, be a single acid or mixture of acids. The fatty carboxylic acid can have about 4 to 30 carbon atoms, 8 to 26 carbon atoms in another instance, and 12 to 22 carbon atoms in yet another instance. Saturated and unsaturated monocarboxylic acids are useful and include capric, lauric, myristic, palmitic, stearic, behenic, oleic, petroselinic, elaidic, palmitoleic, linoleic, linolenic and erucic acid.

The polyhydric alcohol used to form the partial ester has two or more hydroxyl groups and includes alkylene glycols, polyalkylene glycols, triols, polyols having more than three hydroxyl groups, and mixtures thereof. Examples of polyhydric alcohols include ethylene glycol, diethylene glycol, neopentyl glycol, glycerol, trimethylol propane, pentaerythritol, and sorbitol.

The partial esters of the present invention, having at least one free hydroxyl group, are commercially available or can be formed by a variety of methods well known in the art. These esters are derived from any of the above described fatty carboxylic acids and polyhydric alcohols or mixtures thereof. Preferred esters are derived from fatty carboxylic acids having about 12 to 22 carbon atoms and glycerol, and will usually be mixtures of mono- and diglycerides. A preferred partial ester is a mixture of glycerol monooleate and glycerol dioleate.

Another derivative of the fatty carboxylic acid that is useful in the present invention is the amide of the fatty carboxylic acid. In general, these compounds are the reaction product of the natural fatty acid oils containing 6 to 22 carbon atoms and an amine. The fatty carboxylic acid of these amides can be saturated or unsaturated aliphatic, can be branched or straight chain, can be a monocarboxylic or polycarboxylic acid, and can be a single acid or mixture of acids. The fatty carboxylic acid can have about 4 to 30 carbon atoms, 8 to 26 carbon atoms in another instance, and 12 to 22 carbon atoms in yet another instance. Saturated and unsaturated monocarboxylic acids are useful and include capric, lauric, myristic, palmitic, stearic, behenic, oleic, petroselinic, elaidic, palmitoleic, linoleic, linolenic and erucic acid.

The amine can be an alkyl amine having from 2-10 carbon atoms, 4-6 in another instance. A preferred amine for us in this present invention is the alkanol amines. The alkanol amine used in the reaction with the fatty acid can be a primary or secondary amine which possesses at least one hydroxy group. The alkanolamine corresponds to the general formula $HN(R'OH)_{2-x}H_x$ wherein R1 is a lower hydrocarbyl having from about two to about six carbon atoms and x is 0 or 1. The expression "alkanolamine" is used in its broadest sense to include compounds containing at least one primary or secondary amine and at least one hydroxy group such as, for example, monoalkanolamines, dialkanolamines, and so forth. It is believed that almost any alkanolamine can be used, although preferred alkanolamines are lower alkanolamines having form about two to about six carbon atoms. The alkanolamine can possess and O or N functionality in addition to the one amino group (that group being a primary of secondary amino group and at least one hydroxy group. Suitable alkanolamines for use herein include monoethanolamine, diethanolamine, propanolamine, isopropanolamine, dipropanolamine, di-isopropanolamine, butanolamines, aminoethylaminoethanols, e.g., 2-(2-aminoethaamino)ethanol, and the like with diethanolamine being preferred. It is also contemplated that mixtures of two or more alkanolamines can be employed.

In general, the reaction can be conducted by heating the mixture of natural oil of the fatty acid and alkanolamine in desired ratio to product the desired reaction product. The reaction can typically be conducted by maintaining the reactants at a temperature of from about 100° C.-200° C. and preferably from about 120° C.-150° C. for a time period ranging from about 1-10 hours and preferably from about 2-4 hours. Typically, the weight ratio of fatty acid to alkanolamine with ordinarily range form about 0.2 to about 3 and preferably from about 0.7 to about 2.

It will be understood by those skilled in the art that the foregoing reaction product will contain a complex mixture of compounds including fatty acid amides, fatty acid esters, fatty acid ester-amides, unreacted starting reactants, free fatty acids, glycerol, and partial fatty acid esters of glycerol (i.e. mono- and di-glycerides). Typically, the reaction products will contain from about 5 to about 65 mole % of the by-product amide mono- and di-ester compounds, about 3 to about 30 mole % of the by-product amino mono and di-ester compound, about 0.1 to about 50 mole % of the by-product hydroxyl mono- and di-ester compounds, about 00.1 to about 30 mole % of the by-product typified by glycerol, about 0.1 to about 30 mole % of the charge triglycerides, etc. The reaction product mixture need not be separated to isolate one or more specific components. Thus, the reaction product mixture can be employed as in the fuel additive composition of this invention.

The friction modifier can be present in the fuel additive concentrate in one embodiment from about 5 to about 30% by weight, in yet another embodiment from about 8 to about 25% by weight, and in another embodiment from about 12% to about 18% by weight when the fuel additive concentrate contains the ashless detergent.

The friction modifier can be present in the fuel additive concentrate in one embodiment from about 5 to about 60% weight, in another embodiment from about 20 to about 50% by weight, and in another embodiment from about 30% to about 50% by weight when the fuel additive concentrate does not contain the ashless detergent.

The friction modifier additive of this invention can be present in a fuel composition on a weight basis at 1 to 10,000 ppm (parts per million), and in other embodiments can be present at 5 to 8,000 ppm, at 10 to 7000 ppm, at 20 to 5000 ppm, at 30 to 2000 ppm, at 40 to 1.000 ppm and at 40 to 200 ppm.

Compatibilizer

The fuel additive concentrate of the present invention can comprise a compatibilizer. The compatibilizer can be selected from the group consisting of low molecular weight carboxylic acid or anhydride or derivative thereof, glycol ether, alkylated phenol, and mixtures thereof.

Low Molecular Weight Carboxylic Acid or Anhydride or Derivative Thereof.

In one embodiment, the compatibilizer can be a low molecular weight carboxylic acid or anhydride or derivative thereof, which can have one or more carboxyl groups, one or more anhydride groups, or one or more carboxyl groups and one or more anhydride groups.

Typical low molecular weight carboxylic acid or anhydride or derivatives thereof may comprise $C_4$ to $C_{50}$, or $C_8$ to $C_{35}$, or $C_8$ to $C_{18}$, or $C_8$ to $C_{16}$ alkenyl succinic anhydride In an embodiment of the invention, the low molecular weight carboxylic acid or anhydride or derivative thereof is a hydrocarbyl-substituted succinic acid or anhydride, and in another embodiment the hydrocarbyl-substituted succinic acid or anhydride is an alkenylsuccinic acid or anhydride. Alkenylsuccinic anhydrides can be prepared by well known methods, such as, reacting a mixture of maleic anhydride and an alkene at 100 to 250° C. and are commercially available. Alkenylsuccinic acids can be easily prepared from their anhydride derivative via hydrolysis of the anhydride with water.

In another embodiment, the compatibilizer can be a derivative of the low molecular weight carboxylic acid or anhydride, such as, carboxylic acid ether, mono acid, di-acid, ester acid, ester amide, ester imide, hydroxyl ester, or mixtures thereof.

The low molecular weight carboxylic acid or anhydride or derivative thereof can be present in the fuel additive concentrate from about 1 to about 10% by weight, from about 2 to about 8% by weight, from about 3% to about 5% by weight when the fuel additive concentrate contains the ashless detergent.

The low molecular weight carboxylic acid or anhydride or derivative thereof can be present in the fuel additive concentrate from about 2 to about 40% by weight, from about 5 to about 25% by weight, from about 5% to about 20% by weight from about 5 to about 15% by weight when the fuel additive concentrate does not contain the ashless detergent.

Alkylated Phenols

In one embodiment, the compatibilizer can be an alkylated phenol where the alkyl substituent has 4 to 18, or from 8 to 16, or from 8-12, or from 10-12 carbon atoms. The alkyl substituent can be derived from an alkene or from a mixture of alkenes where each alkene has a different number of carbon atoms such as a mixture of $C_{12}$ and $C_{14}$ alkenes. The alkene can be linear, branched, or a mixture thereof. The alkene can be an alpha-olefin or 1-alkene, an internal alkene, or a mixture thereof. The alkylated phenol can be prepared by alkylating phenol with alkenes by well known methods and are commercially available. Useful alkylphenols include heptylphenol and dodecylphenol derived from a polypropylene tetramer.

In another embodiment, the compatibilizer can be a derivative of the alkylated phenol, such as, ether, ester, the reaction product of aldehyde and amine; or mixtures thereof.

The alkylated phenol can be present in the fuel additive concentrate from about 1 to about 10% by weight, or from about 2 to about 8% by weight, or from about 3% to about 5% by weight when the fuel additive concentrate contains the ashless detergent.

The alkylated phenols can be present in the fuel additive concentrate from about 10 to about 50% weight, or from about 10 to about 40% by weight, or from about 10% to about 25% by weight, or from about 10 to about 20% by weight when the fuel additive concentrate does not contain the ashless detergent Glycol Ether In one embodiment, the compatibilizer can be glycol ether. The glycol ether can be an alkyl glycol monoalkyl ether of the formula $RO(CH_2CH(R'')O)_nH$ where in R is a C1 to C4 alkyl and n is a number from 1 to 3 and R" is hydrogen of methyl. The glycol monoalkyl ether of the present invention includes, e.g., ethylene glycol monomethyl ether (2-methoxyethanol), ethylene glycol monomethyl ether (2-ethoxyethanol), ethylene glycol mono propyl ether, ethylene glycol monobutyl ether, diethylene glycol monomethyl ether, triethylene glycol monomethyl ether, diethylene glycol monomethyl ether and triethylene glycol monomethyl ether. Ethylene glycol monobutyl ether is available from Dow chemical as Butyl Cellosolve™.

In another embodiment the compatibilizer can be a derivative the glycol ether, such as, glycol ether amine, glycol ether ester, glycol ether amide, or mixtures thereof.

The glycol ether can be present in the fuel additive concentrate from about 1 to about 10% by weight, or from about 2 to about 8% by weight, or from about 3% to about 5% by weight when the fuel additive concentrate contains the ashless detergent.

The glycol ether can be present in the fuel additive concentrate from about 5 to about 50% by weight, or from 10 to about 40% by weight, or from about 10 to about 25% by weight or from about 10 to about 20% by weight when the fuel additive concentrate does not contain the ashless detergent In a further embodiment, the compatibilizer of the present invention can have a hydrophilic lipophilic balance (HLB) value from 0 to 6, or from 0 to 5, or from about 1 to about 5, or from about 1 to about 4. HLB values can be calculated as a function of molecular volume and water of salvation as described by John C. McGowan in "A New Approach for the Calculation of HLB Values of Surfactants" Tenside Surf. Det. 27 (1990) 4, pp. 229-230 via the formula $HLB=7-(0.337)(10^5)(Vx)+(1.5)(n)$.

Fluid

In one embodiment, the filet additive concentration of the present invention remains a fluid at 0° C., or −8° C., or −18° C., or −20° C., or −30° C., or even −40° C., or lower temperatures. In one embodiment, the fuel additive concentration in its fluid state is substantially free of precipitate and/or sediment, (characterized as "medium" sediment). In yet another embodiment, the fluid is free from suspension, flocculent, and substantial separation (i.e., formation of multiple phases) and in any event is not a solid. However, the fluid additive concentration can be clear, slightly hazy, hazy, exhibiting trace sediment, and/or light sediment and still be considered "fluid".

| | |
|---|---|
| Clear | Fluid |
| Slightly Hazy | Fluid |
| Hazy | Fluid |
| Trace Sediment | Fluid |
| Light Sediment* | Fluid |
| Medium Sediment** | Not Fluid |
| Heavy Sediment | Not Fluid |
| Suspension*** | Not Fluid |
| Flocculent**** | Not Fluid |
| Separation | Not Fluid |
| Solid | Not Fluid |

Note:
*Thin layer of film of sediment less than 1/16 of an inch
**Layer of sediment greater than 1/16 of an inch
***Wispy appearances suspended in blend
****Snowflake-like appearances in blend Fuel Additive Concentrate The fuel additive concentrate of the present invention can be present in the fuel composition in one embodiment from 1-10000 ppm, in another embodiment 5-8000 ppm, in another embodiment 10-5000 ppm or 20-5000 ppm, in yet another embodiment 100-4000 ppm, and in another embodiment 300-2000 or 300-1000 ppm.

Detergent

The fuel additive concentrate composition of the present invention can further comprises a detergent or an ashless detergent.

In one embodiment, the detergent of the present invention can be a Mannich detergent, sometimes referred to as a Mannich base detergent. Mannich detergent is a reaction product of a hydrocarbyl-substituted phenol, an aldehyde, and an amine or ammonia. The hydrocarbyl substituent of the hydrocarbyl-substituted phenol can have 10 to 400 carbon atoms, in another instance 30 to 180 carbon atoms, and in a further instance 10 or 40 to 110 carbon atoms. This hydrocarbyl substituent can be derived from an olefin or a polyolefin. Useful olefins include alpha-olefins, such as 1-decene, which are commercially available.

The polyolefins which can form the hydrocarbyl substituent can be prepared by polymerizing olefin monomers by well known polymerization methods and are also commercially available. The olefin monomers include monoolefins, including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful olefin monomers also include diolefins such as isoprene and 1,3-butadiene. Olefin monomers can also include mixtures of two or more monoolefins, of two or more diolefins, or of one or more monoolefins and one or more diolefins. Useful polyolefins include polyisobutylenes having a number average molecular weight of 140 to 5000, in another instance of 400 to 2500, and in a further instance of 140 or 500 to 1500. The polyisobutylene can have a vinylidene double bond content of 5 to 69 percent, in a second instance of 50 to 69 percent, and in a third instance of 50 to 95 percent or mixtures thereof. The polyolefin can be a homopolymer prepared from a single olefin monomer or a copolymer prepared from a mixture of two or more olefin monomers. Also possible as the hydrocarbyl substituent source are mixtures of two or more homopolymers, two or more copolymers, or one or more homopolymers and one or more copolymers.

The hydrocarbyl-substituted phenol can be prepared by alkylating phenol with an olefin or polyolefin described above, such as a polyisobutylene or polypropylene, using well-known alkylation methods.

The aldehyde used to form the Mannich detergent can have 1 to 10 carbon atoms, and is generally formaldehyde or a reactive equivalent thereof such as formalin or paraformaldehyde.

The amine used to form the Mannich detergent can be a monoamine or a polyamine, including alkanolamines having one or more hydroxyl groups, as described in greater detail above. Useful amines include those described above, such as ethanolamine, diethanolamine, methylamine, dimethylamine, ethylenediamine, dimethylaminopropylamine, diethylenetriamine and 2-(2-aminoethylamino) ethanol. The Mannich detergent can be prepared by reacting a hydrocarbyl-substituted phenol, an aldehyde, and an amine as described in U.S. Pat. No. 5,697,988. In one embodiment of this invention the Mannich reaction product is prepared from an alkylphenol derived from a polyisobutylene, formaldehyde, and an amine that is a primary monoamine, a secondary monoamine, or an alkylenediamine, in particular, ethylenediamine or dimethylamine.

The Mannich reaction product of the present invention can be prepared by reacting the alkyl-substituted hydroxyaromatic compound, aldehyde and polyamine by well known methods including the method described in U.S. Pat. No. 5,876,468.

The Mannich reaction product can be prepared by well known methods generally involving reacting the hydrocarbyl substituted hydroxy aromatic compound, an aldehyde and an amine at temperatures between 50 to 200° C. in the presence of a solvent or diluent while removing reaction water as described in U.S. Pat. No. 5,876,468.

In another embodiment, the detergent of the present invention can be a succinimide detergent. Succinimide detergents are well known in the field of lubricants and include primarily what are sometimes referred to as "ashless" detergents because they do not contain ash-forming metals and they do not normally contribute any ash forming metals when added to a lubricant. Succinimide detergents are the reaction product of a hydrocarbyl substituted succinic acylating agent and an amine containing at least one hydrogen attached to a nitrogen atom. The term "succinic acylating agent" refers to a hydrocarbon-substituted succinic acid or succinic acid-producing compound (which term also encompasses the acid itself). Such materials typically include hydrocarbyl-substituted succinic acids, anhydrides, esters (including half esters) and halides.

Succinic based detergents have a wide variety of chemical structures including typically structures, such as,

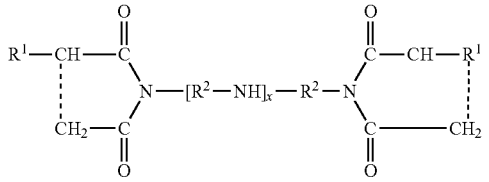

In the above structure, each $R^1$ is independently a hydrocarbyl group, which may be bound to multiple succinimide groups, typically a polyolefin-derived group having an $\overline{M}_n$ of 500 or 700 to 10,000. Typically the hydrocarbyl group is an alkyl group, frequently a polyisobutylene group with a molecular weight of 500 or 700 to 5000, or 1500 or 2000 to 5000. Alternatively expressed, the $R^1$ groups can contain 40 to 500 carbon atoms or at least 50 to 300 carbon atoms, e.g., aliphatic carbon atoms. The $R^2$ are allylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide detergents are more fully described in U.S. Pat. Nos. 4,234,435, 3,172,892, and 6,165,235.

The polyalkenes from which the substituent groups are derived are typically homopolymers and interpolymers of polymerizable olefin monomers of 2 to 16 carbon atoms; usually 2 to 6 carbon atoms.

The olefin monomers from which the polyalkenes are derived are polymerizable olefin monomers characterized by the presence of one or more ethylenically unsaturated groups (i.e., >C=C<); that is, they are mono-olefinic monomers such as ethylene, propylene, 1-butene, isobutene, and 1-octene or polyolefinic monomers (usually diolefinic monomers) such as 1,3-butadiene, and isoprene. These olefin monomers are usually polymerizable terminal olefins; that is, olefins characterized by the presence in their structure of the group >C═$CH_2$. Relatively small amounts of non-hydrocarbon substituents can be included in the polyolefin, provided that such substituents do not substantially interfere with formation of the substituted succinic acid acylating agents.

Each $R^1$ group may contain one or more reactive groups, e.g., succinic groups, thus being represented (prior to reaction with the amine) by structures such as

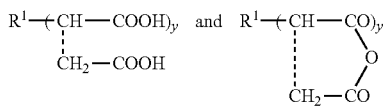

in which y represents the number of such succinic groups attached to the $R^1$ group. In one type of detergent, y=1. In another type of detergent, y is greater than 1, in one embodiment greater than 1.3 or greater than 1.4; and in another embodiment y is equal to or greater than 1.5. in one embodiment y is 1.4 to 3.5, such as 1.5 to 3.5 or 1.5 to 2.5. Fractional values of y, of course, can arise because different specific $R^1$ chains may be reacted with different numbers of succinic groups.

The amines which are reacted with the succinic acylating agents to form the carboxylic detergent composition can be monoamines or polyamines. In either case they will be characterized by the formula $R^4R^5NH$ wherein $R^4$ and $R^5$ are each independently hydrogen, hydrocarbon, amino-substituted hydrocarbon, hydroxy-substituted hydrocarbon, alkoxy-substituted hydrocarbon, amino, carbamyl, thiocarbamyl, guanyl, or acylimidoyl groups provided that no more than one of $R^4$ and $R^5$ is hydrogen. In all cases, therefore, they will be characterized by the presence within their structure of at least one H—N<group. Therefore, they have at least one primary (i.e., $H_2N$—) or secondary amino i.e., H—N<) group). Examples of monoamines include ethylamine, diethylamine, n-butylamine, di-n-butylamine, allylamine, isobutyl amine, cocoamine, stearylamine, laurylamine, methyllaurylamine, oleylamine, N-methyl-octylamine, dodecylamine, and octadecylamine.

The polyamines from which the detergent is derived include principally alkylene amines conforming, for the most part, to the formula

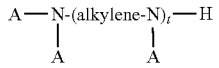

wherein t is an integer typically less than 10, A is hydrogen or a hydrocarbyl group typically having up to 30 carbon atoms, and the alkylene group is typically an alkylene group having less than 8 carbon atoms. The alkylene amines include principally, ethylene amines, hexylene amines, heptylene amines, octylene amines, other polymethylene amines. They are exemplified specifically by: ethylene diamine, diethylene triamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine. Higher homologues such as are obtained by condensing two or more of the above-illustrated alkylene amines likewise are useful. Tetraethylene pentamine is particularly useful.

The ethylene amines, also referred to as polyethylene polyamines, are especially useful. They are described in some detail under the heading "Ethylene Amines" in Encyclopedia of Chemical Technology, Kirk and Othlmer, Vol. 5, pp. 898-905, Interscience Publishers, New York (1950).

Hydroxyalkyl-substituted alkylene amines, i.e., alkylene amines having one or more hydroxyalkyl substituents on the nitrogen atoms, likewise are useful. Examples of such amines include N-(2-hydroxyethyl)ethylene diamine, N,N'-bis(2-hydroxyethyl)-ethylene diamine, 1-(2-hydroxyethyl)piperazine, monohydroxy-propyl)-piperazine, di-hydroxypropy-substituted tetraethylene pentamine, N-(3-hydroxypropyl)-tetra-methylene diamine, and 2-heptadecyl-1-(2-hydroxyethyl)-imidazoline.

Higher homologues, such as are obtained by condensation of the above-illustrated alkylene amines or hydroxy alkyl-substituted alkylene amines through amino radicals or through hydroxy radicals, are likewise useful. Condensed polyamines are formed by a condensation reaction between at least one hydroxy compound with at least one polyamine reactant containing at least one primary or secondary amino group and are described in U.S. Pat. No. 5,230,714 (Steckel).

The succinimide detergent is referred to as such since it normally contains nitrogen largely in the form of imide functionality, although it may be in the form of amine salts, amides, imidazolines as well as mixtures thereof. To prepare the succinimide detergent, one or more of the succinic acid-producing compounds and one or more of the amines are heated, typically with removal of water, optionally in the presence of a normally liquid, substantially inert organic liquid solvent/diluent at an elevated temperature, generally in the range of 80° C. up to the decomposition point of the mixture or the product; typically 100° C. to 300° C.

The succinic acylating agent and the amine (or organic hydroxy compound, or mixture thereof) are typically reacted in amounts sufficient to provide at least one-half equivalent, per equivalent of acid-producing compound, of the amine (or hydroxy compound, as the case may be). Generally, the maximum amount of amine present will be about 2 moles of amine per equivalent of succinic acylating agent. For the purposes of this invention, an equivalent of the amine is that amount of the amine corresponding to the total weight of amine divided by the total number or nitrogen atoms present. The number of equivalents of succinic acid-producing compound will vary with the number of succinic groups present therein, and generally, there are two equivalents of acylating reagent for each succinic group in the acylating reagents. Additional details and examples of the procedures for preparing the succinimide detergents of the present invention are included in, for example, U.S. Pat. Nos. 3,172,892; 3,219,666; 3,272,746; 4,234,435; 6,440,905 and 6,165,235.

In yet another embodiment, the detergent of the present invention can be a polyisobutylene amine. The amine use to make the polyisobutylene amine can be a polyamine such as ethylenediamine, 2-(2-aminoethylamino)ethanol, or diethylenetriamine. The polyisobutylene amine of the present invention can be prepared by several known methods generally involving amination of a derivative of a polyolefin to include a chlorinated polyolefin, a hydroformylated polyolefin, and an epoxidized polyolefin. In one embodiment of the invention the polyisobutylene amine is prepared by chlorinating a polyolefin such as a polyisobutylene and then reacting the chlorinated polyolefin with an amine such as a polyamine at elevated temperatures of generally 100 to 150° C. as described in U.S. Pat. No. 5,407,453. To improve processing a solvent can be employed, an excess of the amine can be used to minimize cross-linking, and an inorganic base such as sodium carbonate can be used to aid in removal of hydrogen chloride generated by the reaction.

Yet another type of detergent, which can be used in the present invention, is a glyoxylate. A glyoxylate detergent is a fuel soluble ashless detergent which, in a first embodiment, is the reaction product of an amine having at least one basic nitrogen, i.e. one >N—H, and a hydrocarbyl substituted acylating agent resulting from the reaction, of a long chain hydrocarbon containing an olefinic bond with at least one carboxylic reactant selected from the group consisting of compounds of the formula (I)

$$(R^1C(O)(R^2)_nC(O))R^3 \quad (I)$$

and compounds of the formula (II)

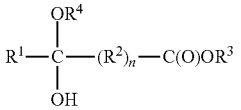

(II)

wherein each of $R^1$, $R^3$ and $R^4$ is independently H or a hydrocarbyl group, $R^2$ is a divalent hydrocarbylene group having 1 to 3 carbons and n is 0 or 1:

Examples of carboxylic reactants are glyoxylic acid, glyoxylic acid methyl ester methyl hemiacetal, and other omega-oxoalkanoic acids, keto alkanoic acids such as pyruvic acid, levulinic acid, ketovaleric acids, ketobutyric acids and numerous others. The skilled worker having the disclosure before him will readily recognize the appropriate compound of formula (I) to employ as a reactant to generate a given intermediate.

The hydrocarbyl substituted acylating agent can be the reaction of a long chain hydrocarbon containing an olefin and the above described carboxylic reactant of formula (I) and (II), further carried out in the presence of at least one aldehyde or ketone. Typically, the aldehyde or ketone contains from 1 to about 12 carbon atoms. Suitable aldehydes include formaldehyde, acetaldehyde, propionaldehyde, butyraldehyde, isobutyraldehyde, pentanal, hexanal, heptaldehyde, octanal, benzaldehyde, and higher aldehydes. Other aldehydes, such as dialdehydes, especially glyoxal, are useful, although monoaldehydes are generally preferred. Suitable ketones include acetone, butanone, methyl ethyl, ketone, and other ketones. Typically, one of the hydrocarbyl groups of the ketone is methyl. Mixtures of two or more aldehydes and/or ketones are also useful.

Compounds and the processes for making these compounds are disclosed in U.S. Pat. Nos. 5,696,060; 5,696,067; 5,739,356; 5,777,142; 5,856,524; 5,786,490; 6,020,500; 6,114,547; 5,840,920 and are incorporated herein by reference.

In another embodiment, the glyoxylate detergent is the reaction product of an amine having at least one basic nitrogen, i.e. one >N—H, and a hydrocarbyl substituted acylating agent resulting from the condensation product of a hydroxyaromatic compound and at least one carboxylic reactant selected from the group consisting of the above described compounds of the formula (I) and compounds of the formula (II). Examples of carboxylic reactants are glyoxylic acid, glyoxylic acid methyl ester methyl hemiacetal, and other such materials as listed above.

The hydroxyaromatic compounds typically contain directly at least one hydrocarbyl group R bonded to at least one aromatic group. The hydrocarbyl group R may contain up to about 750 carbon atoms or 4 to 750 carbon atoms, or 4 to 400 carbon atoms or 4 to 100 carbon atoms. In one embodiment, at least one R is derived from polybutene. In another embodiment, R is derived from polypropylene.

In another embodiment, the reaction of the hydroxyaromatic compound and the above described carboxylic acid reactant of formula (I) or (II) can be carried out in the presence of at least one aldehyde or ketone. The aldehyde or ketone reactant employed in this embodiment is a carbonyl compound other than a carboxy-substituted carbonyl compound. Suitable aldehydes include monoaldehydes such as formaldehyde, acetaldehyde, propionaldehyde, butyraldehyde, isobutylaldelhyde, pentanal, hexanal, heptaldehyde, octanal, benzaldehyde, and higher aldehydes. Other aldehydes, such as dialdehydes, especially glyoxal, are useful. Suitable ketones include acetone, butanone, methyl ethyl ketone, and other ketones. Typically, one of the hydrocarbyl, groups of the ketone is methyl. Mixtures of two or more aldehydes and/or ketones are also useful.

Compounds and the processes for making these compounds are disclosed in U.S. Pat. Nos. 3,954,808; 5,336,278; 5,620,949 and 5,458,793 and are incorporated herein by reference The detergent additive of this invention can be present in a mixture of various detergents referenced above.

In one embodiment, the detergent additive of this invention can be present in the fuel additive concentrate at about 3 to about 60% by weight, or from about 3 to about 50% by weight, or from about 3 to about 20% weight by weight, or from about 10 to about 20% by weight.

The detergent additive of this invention can be present in a fuel composition in one embodiment on a weight basis at 1 to 10,000 ppm (parts per million), and in other embodiments can be present at 10 to 5,000 ppm, at 10 to 3000 ppm, at 10 to 1000, or at 10 to 600 or at 10 to 300 ppm.

Fluidizer

The fuel additive concentrate of the present invention can additionally contain a fluidizer.

In one embodiment, the fluidizer can be a polyetheramines. In another embodiment, the polyetheramine can be a detergent. The polyetheramine can be represented by the formula R[/OCH2CH(R1)]nA, where R is a hydrocarbyl group, R1 is selected from the group consisting of hydrogen, hydrocarbyl groups of 1 to 16 carbon atoms, and mixtures thereof, n is a number from 2 to about 50, and A is selected from the group consisting of —OCH2CH2CH2NR2R2 and —NR3R3, where each R2 is independently hydrogen or hydrocarbyl, and each R3 is independently hydrogen, hydrocarbyl or —[R4N(R5)]pR6, where R4 is C2-C10 alkylene, R5 and R6 are independently hydrogen or hydrocarbyl, and p is a number from 1-7. These polyetheramines can be prepared by initially condensing an alcohol or alkylphenol with an alkylene oxide, mixture of alkylene oxides or with several alkylene oxides in sequential fashion in a 1:2-50 mole ratio of hydric compound to alkylene oxide to form a polyether intermediate. U.S. Pat. No. 5,094,667 provides reaction conditions for preparing a polyether intermediate, the disclosure of which is incorporated herein by reference. In one embodiment, the alcohols can be linear or branched from 1 to 30 carbon atoms, in another embodiment 6 to 20 carbon atoms, in yet another embodiment from 10 to 16 carbon atoms. The alkyl group of the alkylphenols can be 1 to 30 carbon atoms, in another embodiment 10 to 20 carbon atoms. Examples of the alkylene oxides include ethylene oxide, propylene oxide or butylene oxide. The number of alkylene oxide units in the polyether intermediate can be 10-35 or 18-27. The polyether intermediate can be converted to a polyetheramine by amination with ammonia, an amine or a polyamine to form a polyetheramine of the type where A is —NR3R3. Published Patent Application EP310875 provides reaction conditions for the animation reaction, the disclosure of which is incorporated herein by reference. Alternately, the polyether intermediate can also be converted to a polyetheramine of the type where A is —OCH2CH2CH2NR2R2 by reaction with acrylonitrile followed by hydrogenation. U.S. Pat. No. 5,094,667 provides reaction conditions for the cyanoethylation and subsequent hydrogenation, the disclosure of which is incorporated herein by reference. Polyetheramines where A is —OCH2CH2CH2NH2 are typically preferred. Commercial examples of polyetheramines are the Techron range from Chevron and the Jeffamine® range from Huntsman.

In another embodiment, the fluidizer can be a polyether, which can be represented by the formula R7O[CH2CH(R8)O]qH, where R7 is a hydrocarbyl group, R8 is selected from the group consisting of hydrogen, hydrocarbyl groups of 1 to 16 carbon atoms, and mixtures thereof, and q is a number from 2 to about 50. Reaction conditions for preparation as well as various embodiments of the Polyethers are presented above in the polyetheramine description for the polyether intermediate. A commercial example of a polyether is the Lyondell ND® series. Other suitable polyethers are also available from Dow Chemicals, Huntsman, and ICI.

In yet another embodiment, the fluidizer can be a hydrocarbyl-terminated poly-(oxyalklene) aminocarbamate as described U.S. Pat. No. 5,503,644.

In yet another embodiment, the fluidizer can be an alkoxylate, wherein the alkoxylate can comprise: (i) a polyether containing two or more ester terminal groups; (ii) a polyether containing one or more ester groups and one or more terminal ether groups; or (iii) a polyether containing one or more ester groups and one or more terminal amino groups wherein a terminal group is defined as a group located within five connecting carbon or oxygen atoms from the end of the polymer. Connecting is defined as the sum of the connecting carbon and oxygen atoms in the polymer or end group.

An alkoxylate can be represented by the formula:

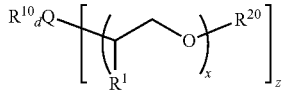

wherein, R10 is H, TC(O)—, or a C1-36 hydrocarbyl group, wherein T is a C1-36 fatty acid hydrocarbyl mixture in tallow fatty acid or a fatty acid free of rosin acid; R20 is H, A, WC(O)—, or mixtures thereof, wherein A is selected from the group consisting of —OCH2CH2CH2NR2R2 and —NR3R3 where each R2 is independently hydrogen or hydrocarbyl, and each R3 is independently hydrogen, hydrocarbyl or —[R4N(R5)]pR6 where R4 is C2-C10 alkylene, R5 and R6 are independently hydrogen or hydrocarbyl, and p is a number from 1-7, W is a $C_{1-36}$ hydrocarbyl group; R1 is selected from the group consisting of hydrogen, hydrocarbyl groups of 1 to 16 carbon atoms; X is an integer from 1 to 36; Z is an integer 1 to 3; Q can be O or N; provided that if Q is N then d can be an integer from 0 to 2 and Z is the integer 3-d; if Q is O then d can be an integer 0 to 1 and Z is the integer 2-d and if Q is O and R1 is C1-36 hydrocarbyl group then R2 is WC(O)—.

Examples of the alkoxylate can include: C12-15 alcohol initiated polypropyleneoxide (22-24) ether amine, Bayer ACTACLEAR ND21-A™ (C12-15 alcohol initiated polypropyleneoxide (22-24) ether-ol), tall oil fatty acid initiated polypropyleneoxide (22-24) ester-ol, butanol initiated polypropylenleoxide (23-25) ether-tallow fatty acid ester, glycerol dioleate initiated polypropyleneoxide (23-25) ether-ol, propylene glycol initiated polypropyleneoxide (33-34) ether tallow fatty acid ester, tallow fatty acid initiated polypropyleneoxide (22-24) ester-ol and C12-15 alcohol initiated polypropyleneoxide (22-24) ether tallow fatty acid ester.

These alkoxylates can be made from the reaction of a fatty acid such as tall oil fatty acids (TOFA), that is, the mixture of fatty acids predominately oleic and linoleic and contains residual rosin acids or tallow acid that is, the mixture of fatty acids predominately stearic, palmitic and oleic with an alcohol terminated polyether such as polypropylene glycol in the presence of an acidic catalyst, usually methane sulfonic acid. These alkoxylates can also be made from the reaction of glycerol dioleate and propylene oxide in the presence of catalyst.

Fuel

The fuel composition of the present invention can comprise the fuel additive concentrate, as described above, and a fuel which is liquid at room temperature and is useful in fueling an engine. The fuel is normally a liquid at ambient conditions e.g., room temperature (20 to 30° C.). The fuel can be a hydrocarbon fuel, a nonhydrocarbon fuel, or a mixture thereof. The hydrocarbon fuel can be a petroleum distillate to include a gasoline as defined by ASTM specification D4814 or a diesel fuel as defined by ASTM specification D975. In an embodiment of the invention the fuel is a gasoline, and in other embodiments the fuel is a leaded gasoline, or a non-leaded gasoline. In another embodiment of this invention the fuel is a diesel fuel. The hydrocarbon fuel can be a hydrocarbon prepared by a gas to liquid process to include for example hydrocarbons prepared by a process such as the Fischer-Tropsch process. The nonhydrocarbon fuel can be an oxygen containing composition, often referred to as an oxygenate, to include an alcohol, an ether, a ketone, an ester of a carboxylic acid, a nitroalkane, or a mixture thereof. The nonhydrocarbon fuel can include, for example, methanol, ethanol, methyl t-butyl ether, methyl ethyl ketone, transesterified oils and/or fats from plants and animals such as rapeseed methyl ester and soybean methyl ester, and nitromethane. In several embodiments of this invention the fuel can have an oxygenate content on a weight basis that is 1 percent by weight, or 10 percent by weight, or 50 percent by weight, or up to 85 percent by weight. Mixtures of hydrocarbon and nonhydrocarbon fuels can include, for example, gasoline and methanol and/or ethanol, diesel fuel and ethanol, and diesel fuel and a transesterified plant oil such as rapeseed methyl ester. In an embodiment of the invention, the liquid fuel can be an emulsion of water in a hydrocarbon fuel, a nonhydrocarbon fuel, or a mixture thereof. In several embodiments of this invention the fuel can have a sulfur content on a weight basis that is 5000 ppm or less, 1000 ppm or less, 300 ppm or less, 200 ppm or less, 30 ppm or less, or 10 ppm or less. In another embodiment, the fuel can have a sulfur-content on a weight basis of 1 to 100 ppm. In one embodiment, the fuel contains 0 ppm to 1000 ppm, or 0 to 500 ppm, or 0 to 100 ppm, or 0 to 50 ppm, or 0 to 25 ppm, or 0 to 10 ppm, or 0 to 5 ppm of alkali metals, alkaline earth metals, transition metals or mixtures thereof. In another embodiment, the fuel contains 1 to 10 ppm by weight of alkali metals, alkaline earth metals, transition metals or mixtures thereof. It is well known in the art that a fuel containing alkali metals, alkaline earth metals, transition metals or mixtures thereof have a greater tendency to form deposits and therefore foul or plug injectors. The fuel of the invention can be present in a fuel composition in a major amount that is generally greater than 50 percent by weight, and in other embodiments is present at greater than 90 percent by weight, greater than 95 percent by weight, greater than 99.5 percent by weight, or greater than 99.8 percent by weight.

The fuel additive concentrate compositions and fuel compositions of the present invention can contain other additives that are well known to those of skill in the art. These can include anti-knock agents such as tetra-alkyl lead compounds and MMT (methylcyclopentadienyl manganese tricarbonyl), lead scavengers such as halo-alkanes, dyes, antioxidants such as hindered phenols, bacteriostatic agents, auxiliary, gum inhibitors, marking agents, metal deactivators, demulsifiers. The fuel compositions of this invention can be lead-containing or lead-free fuels.

EXAMPLES

The invention will be further illustrated by the following examples, which sets forth particularly advantageous embodiments. While the examples are provided to illustrate the present invention, they are not intended to limit it.

The fuel additive concentrates are evaluated in a storage stability test and the HFRR test. The storage stability test procedure is as follows. Approximately 50 grams of the fuel additive concentrates samples are placed in glass vials and stored at the following temperatures: 0° C., −8° C., −18° C., and −40° C. for up to 28 days. The samples are visual inspected and rated per the table below after day 14 and day 28. The result of this test can be found in Tables 1 and 2.

| Storage Stability Rating Table | |
|---|---|
| Z | Hazy |
| SLZ | Slightly Hazy |
| S | Solid |
| H | Heavy Sediment |
| M | Medium Sediment |
| L | Light Sediment* |
| T | Trace Sediment** |
| Q | Separation |
| F | Flocculent**** |
| N | Suspension*** |

*Thin layer of film of sediment less than 1/16 of an inch
**Layer of sediment greater than 1/16 of an inch
***Wispy appearances suspended in blend
****Snowflake-like appearances in blend Additionally, the fuel additive concentrate are evaluated in the HFRR test, which is used to evaluate the friction and wear performance of additives. The wear scar diameter is measured by using a reciprocating steel ball bearing which slides against a flat steel plate. This test is run using a High Frequency Reciprocating Wear Rig, which is a commercially available piece of tribology test equipment. The result of this test can be found in Table 3.

TABLE 1

Storage Stability

| | | | Solvent | | | Compatibilizer | | | | | Storage at −8° C. 14 days | Storage at −18° C. 14 days |
|---|---|---|---|---|---|---|---|---|---|---|---|---|
| Example | GMO | Amine | A | B | C | A | B | C | D | E | RATING | |
| Comparative 1 | 22.5 | 22.5 | 27.5 | | | 27.5 | | | | | SLZ/Q | Z/S |
| Comparative 2 | 22.5 | 22.5 | | 27.5 | | | 27.5 | | | | — | Z/H |
| Comparative 3 | 22.5 | 22.5 | | | 27.5 | | 27.5 | | | | — | Z/S |
| Example 4 | 22.5 | 22.5 | | | 20.0 | 10.0 | | 25.0 | | | Z | Z |
| Example 5 | 22.5 | 22.5 | | | 20.0 | 20.0 | | 15.0 | | | Z | Z |
| Example 6 | 22.5 | 22.5 | | | 30.0 | 10.0 | | 15.0 | | | Z | Z |
| Example 7 | 22.5 | 22.5 | | | 22.5 | 22.5 | | 10.0 | | | Z | Z |
| Example 8 | 22.5 | 22.5 | | | 30.0 | 15.0 | | 10.0 | | | Z | Z |
| Example 9 | 22.5 | 22.5 | | | 21.5 | 21.5 | | | 12.0 | | Z | Z |
| Example 10 | 22.5 | 22.5 | | | 30.0 | 13.0 | | | 12.0 | | Z | Z |
| Example 11 | 22.5 | 22.5 | | | 23.5 | 23.5 | | | 8.0 | | Z/T | Z/T |
| Example 12 | 22.5 | 22.5 | | | 30.0 | 17.0 | | | 8.0 | | Z | Z |
| Example 13 | 22.5 | 22.5 | 30.0 | | | 15.0 | | 10.0 | | | Z | Z |
| Example 14 | 22.5 | 22.5 | 30.0 | | | 17.0 | | | 8.0 | | Z | Z |
| Example 15 | 22.5 | 22.5 | | | 22.5 | | | | | 35 | Z | Z |
| Example 16 | 22.5 | 22.5 | | 20 | | | | | | 35 | Z | Z |

Note:
The numerical values in the Table 1 are in weight percent unless indicated otherwise
Solvent A is Heavy aromatic petroleum distillate
Solvent B is Kerosene
Solvent C is Petroleum middle distillates
Compatibilizer A is C8 branched alcohol
Compatibilizer B is 50/50 mixture of C5 linear alcohol and C4 Branched Alcohol
Compatibilizer C is C12 Alkenyl succinic acid
Compatibilizer D is C12 succinic anhydride
Compatibilizer E is C12 Alkylated phenol

TABLE 2

Storage Stability

| | | | Solvent | | | Compatibilizer | | | | Detergent | | Storage @28 days | | | |
|---|---|---|---|---|---|---|---|---|---|---|---|---|---|---|---|
| Example | GMO | Amine | A | B | C | A | D | E | G | A | B | 0° C. | −8° C. | −18° C. | −40° C. |
| Comparative 4 | 7.5 | 7.5 | 9.17 | 22.72 | | 9.17 | | | | 41.6 | 2.35 | C/L | | C/M | |
| Example 17 | 7.5 | 7.5 | 9.17 | 17.72 | | 9.17 | 5.0 | | | 41.6 | 3.35 | C | | C | C |

TABLE 2-continued

| Storage Stability | | | | | | | | | | | | | | | |
|---|---|---|---|---|---|---|---|---|---|---|---|---|---|---|---|
| | | | Solvent | | | Compatibilizer | | | | Detergent | | Storage @28 days | | | |
| Example | GMO | Amine | A | B | C | A | D | E | G | A | B | 0° C. | −8° C. | −18° C. | −40° C. |
| Example 18 | 7.5 | 7.5 | 9.17 | 19.39 | | 9.17 | 3.33 | | | 41.6 | 3.35 | C | | C | C |
| Example 19 | 7.5 | 7.5 | 9.17 | 14.65 | | 9.17 | 8.07 | | | 41.6 | 3.35 | C | | C | C |
| Comparative 5 | 6.66 | 6.66 | 8.14 | 21.94 | | 8.14 | | | | 34.98 | 13.48 | SLZ/M | | SLZ/M | |
| Example 20 | 6.66 | 6.66 | 8.14 | 18.98 | | 8.14 | 2.96 | | | 34.98 | 13.48 | C | | C | |
| Comparative 6* | 6.66 | 6.66 | 8.14 | 21.04 | | 8.14 | | | | 34.98 | 13.48 | SLZ/M | | SLZ/H | |
| Example 21* | 6.66 | 6.66 | 8.14 | | | 8.14 | 2.96 | | | 34.98 | 13.48 | C | | C | |
| Comparative 7 | 4.17 | 4.17 | | | 77.35 | 10 | | | | 3.12 | 1.20 | C/T | | Z/H/F/N/Q | Z/H/Q |
| Example 22 | 4.17 | 4.17 | | | 73.97 | 10 | | | 3.6 | 3.12 | 1.20 | C/T | | C/L | C/Q |
| Example 23 | 4.17 | 4.17 | | | 68.97 | 10 | 5.0 | | 3.6 | 3.12 | 1.20 | C/T | | C/L | C/Q |
| Example 24 | 4.17 | 4.17 | | | 78.97 | | | 5.0 | 3.6 | 3.12 | 1.20 | C/T | | C/L | C/Q |
| Comparative 8** | 8.44 | 8.44 | 10.31 | 18.31 | | 10.31 | | | | 31.13 | 12.0 | C/M | SLZ/M | C/F/H | |
| Example 25** | 8.44 | 8.44 | 10.31 | 14.55 | | 10.31 | 3.75 | | | 31.13 | 12.0 | C | C | C | |

Note:
The numerical values in the Table 2 are in weight percent unless indicated otherwise
*Blends also contains 0.9 Wt % Marker.
**Blends contain demulsifier and corrosion inhibitor
Solvent A is Heavy aromatic petroleum distillate
Solvent B is Kerosene
Solvent C is Petroleum naphtha
Compatibilizer A is C8 Alkyl alcohol
Compatibilizer D is C12 succinic anhydride
Compatibilizer G is Ethylene glycol mono C4 alkyl ether
Detergent A is Mannich type Hydrocarbyl amine
Detergent B is a Polyether amine The data found in Tables 1 and 2 shows that the present invention remains a stable fuel additive concentrate at low temperatures.

TABLE 3

| HFRR Data | | | | | | | | | | |
|---|---|---|---|---|---|---|---|---|---|---|
| | | | Solvent | | Compatibilizer | | | | | HFRR Wear Scar |
| | GMO | Amine | A | C | A | B | C | D | F | (mm) |
| Base fuel | | | | | | | | | | 0.791 mm |
| Comparative 1 | 22.5 | 22.5 | 27.5 | | 27.5 | | | | | 0.368 mm |
| Comparative 3 | 22.5 | 22.5 | | 27.5 | | 27.5 | | | | 0.352 mm |
| Example 13 | 22.5 | 22.5 | 30 | | 15 | | | 10 | | 0.332 mm |
| Example 14 | 22.5 | 22.5 | 30 | | 17 | | | 8 | | 0.299 mm |
| Example 31 | 22.5 | 22.5 | | 20 | 17.5 | | | | 17.5 | 0.346 mm |
| Example 5 | 22.5 | 22.5 | | 20 | 20 | | 15 | | | 0.341 mm |
| Example 7 | 22.5 | 22.5 | | 22.5 | 22.5 | | 10 | | | 0.329 mm |
| Example 9 | 22.5 | 22.5 | | 21.5 | 21.5 | | | 12.0 | | 0.325 mm |

Note:
All the examples in Table 3 were dosed with equal amounts of fuel

Note:
All values in the Table 3 are in weight percent unless indicated otherwise
Solvent A is Heavy aromatic petroleum distillate
Solvent C is Petroleum middle distillates
Compatibilizer A is C8 branched alcohol
Compatibilizer B is 50/50 mixture of C5 linear alcohol and C4 branched Alcohol
Compatibilizer C is C12 Alkenyl succinic acid
Compatibilizer D is C12 succinic anhydride
Compatibilizer E is C12 Alkylated phenol
Compatibilizer F is C18 alkenyl succinic anhydride The data on Table 3 demonstrates that a fuel composition containing the fuel additive concentrate of the present invention has wear and fuel economy benefits.

What is claimed is:

1. A fuel additive concentrate comprising, a) an aliphatic or aromatic hydrocarbon solvent other than component (c);

b) a friction modifier comprising a combination of an alkoxylated fatty amine and a fatty acid or derivative thereof, where the alkoxylated fatty amine has the formula:

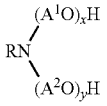

where R is a hydrocarbyl group having about 4 to 30 carbon atoms, $A^1$ and $A^2$ are vicinal alkylene groups, and the sum of x and y is an integer and is at least 1, and where the fatty acid or derivative thereof contains about 4 to 30 carbon atoms and comprises a fatty carboxylic acid, a partial ester of a fatty carboxylic acid, or a combination thereof;

c) a branched aliphatic alcohol containing up to 16 carbon atoms; and d) a compatibilizer comprising a succinic acid or succinic anhydride containing 4 to 50 carbon atoms;

wherein the fuel additive concentrate remains fluid at −8° C. or lower;

wherein the solvent of component (a) has enough aromatic content to permit the fuel additive concentrate to be a fluid at −8° C.;

wherein the additive concentrate contains an ashless detergent and wherein (a) the solvent is present at 10% to 90% by weight, (b) the friction modifier is present at 5% to 60% by weight, (c) the alcohol is present at 5% to 20% by weight and (d) the compatibilizer is present at 1% to 50% by weight.

2. The fuel additive concentrate of claim 1 further comprising an detergent, a fluidizer or mixtures thereof.

3. The fuel additive concentrate of claim 1 wherein component (a) is petroleum middle distillate.

4. The fuel additive concentrate of claim 1 wherein component (b) comprises a combination of glycerol monooleate and diethoxylated tallowamine.

5. The fuel additive concentrate of claim 1 wherein component (c) comprises a branched alcohol containing about 8 carbon atoms.

6. The fuel additive concentrate of claim 1 wherein component (d) comprises a succinic acid or succinic anhydride containing 8 to 16 carbon atoms.

7. A method of improving the storage stability of a fuel additive concentrate, said method comprising the step of (1) preparing a fuel additive concentrate by combining:

a) an aliphatic or aromatic hydrocarbon solvent other than component (c);

b) a friction modifier comprising a combination of an alkoxylated fatty amine and a fatty acid or derivative thereof, where the alkoxylated fatty amine has the formula:

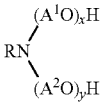

where R is a hydrocarbyl group having about 4 to 30 carbon atoms, $A^1$ and $A^2$ are vicinal alkylene groups, and the sum of x and y is an integer and is at least 1, and where the fatty acid or derivative thereof contains about 4 to 30 carbon atoms and comprises a fatty carboxylic acid, a partial ester of a fatty carboxylic acid, or a combination thereof;

c) a branched aliphatic alcohol containing up to 16 carbon atoms; and d) a compatibilizer comprising a succinic acid or succinic anhydride containing 4 to 50 carbon atoms;

resulting in a fuel additive concentrate, wherein the fuel additive concentrate remains fluid at −8° C. or lower;

wherein the solvent of component (a) has enough aromatic content to permit the fuel additive concentrate to be a fluid at −8° C.;

wherein the additive concentrate contains an ashless detergent and wherein (a) the solvent is present at 10% to 90% by weight, (b) the friction modifier is present at 5% to 60% by weight, (c) the alcohol is present at 5% to 20% by weight and (d) the compatibilizer is present at 1% to 50% by weight.

8. The method of claim 7 where the additive concentrate further comprise an detergent, a fluidizer or mixtures thereof.

9. The method of claim 7 wherein component (a) is petroleum middle distillate.

10. The method of claim 7 wherein component (b) comprises a combination of glycerol monooleate and diethoxylated tallowamine.

11. The method of claim 7 wherein component (c) comprises a branched alcohol containing about 8 carbon atoms.

12. The method of claim 7 wherein component (d) comprises a succinic acid or succinic anhydride containing 8 to 16 carbon atoms.

13. The composition of claim 1 wherein component (a) comprises a heavy aromatic petroleum distillate, kerosene, or petroleum middle distillate;

wherein component (b) comprises a fatty carboxylic acid, a partial ester of a fatty carboxylic acid, or a combination thereof; and wherein component (c) comprises a branched aliphatic alcohol containing up to 10 carbon atoms.

14. The method of claim 7 wherein component (a) comprises a heavy aromatic petroleum distillate, kerosene, or petroleum middle distillate;

wherein component (b) comprises a fatty carboxylic acid, a partial ester of a fatty carboxylic acid, or a combination thereof; and wherein component (c) comprises a branched aliphatic alcohol containing up to 10 carbon atoms.

* * * * *